US006350100B1

(12) United States Patent
Naruse et al.

(10) Patent No.: US 6,350,100 B1
(45) Date of Patent: Feb. 26, 2002

(54) TILT CONTROL DEVICE FOR FORKLIFT

(75) Inventors: Yasuhiko Naruse; Toshiyuki Takeuchi, both of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/079,721

(22) Filed: May 15, 1998

(51) Int. Cl.[7] ..... B66F 9/22
(52) U.S. Cl. ..... 414/635; 414/636
(58) Field of Search ..... 414/635, 636

(56) References Cited

U.S. PATENT DOCUMENTS

| | | | | |
|---|---|---|---|---|
| 3,831,492 A | * | 8/1974 | Young | 414/636 X |
| 4,093,091 A | | 6/1978 | Gregg et al. | |
| 4,126,237 A | * | 11/1978 | Downing et al. | 414/636 |
| 4,411,582 A | * | 10/1983 | Nakada | 414/636 |
| 4,459,081 A | | 7/1984 | Reeves | |
| 4,499,541 A | * | 2/1985 | Yuki et al. | 414/636 X |
| 4,511,974 A | * | 4/1985 | Nakane et al. | 414/634 X |
| 4,520,443 A | * | 5/1985 | Yuki et al. | 414/636 X |

FOREIGN PATENT DOCUMENTS

| | | | | |
|---|---|---|---|---|
| JP | 58-12600 | | 1/1983 | B66F/9/22 |
| JP | 2310298 | * | 12/1990 | 414/636 |
| JP | 3-73598 | | 7/1991 | B66F/9/24 |
| JP | 5229792 | * | 9/1993 | 414/636 |
| JP | 5254796 | * | 10/1993 | 414/636 |
| JP | 6-15990 | | 4/1994 | B66F/9/22 |
| JP | 7-479 | | 1/1995 | B66F/9/24 |
| JP | 891798 | * | 4/1996 | 414/636 |
| JP | 8143293 | * | 6/1996 | 414/636 |
| JP | 09-25099 | | 1/1997 | B66F/9/24 |
| JP | 977495 | * | 3/1997 | 414/636 |
| JP | 09-104598 | | 4/1997 | B66F/9/20 |

* cited by examiner

*Primary Examiner*—Steven A. Bratlie
(74) *Attorney, Agent, or Firm*—Morgan & Finnegan, LLP

(57) ABSTRACT

A device for controlling tilt of a forklift mast. A fork for carrying an object is supported by the mast so that the fork is lifted or lowered. A tilt cylinder operates to tilt the mast hydraulically. A hydraulic valve supplies oil to the tilt cylinder in correspondence with the position of a tilt lever. The tilt cylinder tilts the mast at a speed corresponding to the flow rate of the oil supplied by the valve. A restricting valve is provided for restricting the maximum flow rate of the oil. When the fork is located below a predetermined reference position, the controller fully opens the restricting valve. However, when the fork is located at the reference position or higher, the controller restricts the opening of the restricting valve, thus restricting the maximum tilt speed of the mast. This stabilizes the forklift.

13 Claims, 5 Drawing Sheets

TILT CONTROL DEVICE FOR FORKLIFT

BACKGROUND OF THE INVENTION

The present invention relates to devices for controlling tilt of forklift masts.

A typical forklift includes a mast and a fork. The mast is supported by a vehicle body so that the mast tilts. The fork is supported by the mast so that the fork is lifted or lowered. The forklift also includes a tilt cylinder and a control valve. The tilt cylinder enables the mast to tilt forward or rearward with respect to the vehicle body. The control valve controls an oil supply for the tilt cylinder. A tilt lever is arranged in the vicinity of the operator seat of the forklift. By shifting the tilt lever, the opening of the control valve is varied so that the tilt cylinder operates to tilt the mast.

The opening of the control valve varies in correspondence with the position of the tilt lever, or the angle of the tilt lever. The flow of oil supplied to the tilt cylinder varies in correspondence with the opening of the valve. Such flow determines the tilt speed of the mast.

The mast is supported by the vehicle body at the lower end of the mast. Thus, regardless of the tilt speed of the mast, the tilt speed of the fork is greater when the position of the fork is higher. If the tilt lever is shifted rapidly to its maximum tilt angle, the mast starts to move immediately and tilts at a high speed. In this case, if the fork is located at a high position are carries an object, the object may become unstable or fall from the fork. It is also possible that a rear wheel of the forklift may be raised from the ground. It is thus necessary to move the tilt lever carefully when the fork is located at a higher position.

To solve the above problem, Japanese Unexamined Patent Publication No. 5-229792 describes a device for controlling the tilt speed of the mast in correspondence with the height of the fork. This device includes sensors for detecting the height of the fork, the weight of the object carried on the fork, and the position of the tilt lever. A controller controls opening of a proportional electromagnetic type control valve in accordance with detection values of the sensors, thus varying the flow of the oil supplied to the tilt cylinder. Specifically, the controller varies instruction values for the opening of the control valve in correspondence with the height of the fork) the weight of the object and the position of the tilt lever. Thus, if the fork is located at a higher position and carries an object, the mast is controlled to tilt at a lower speed. In this manner, even when the tilt lever is shifted to the maximum speed position, problems related to instability do not occur.

The above described control valve includes a solenoid that operates to vary the opening of such valve. While detecting the position of the tilt lever, a controller varies the value of the current supplied to the solenoid as an instruction value in correspondence with variation of the lever position. However, this control method results in a time lag between the shifting of the tilt lever and the operation of the tilt cylinder in response to the position of the tilt lever. That is, the operation of the tilt cylinder does not respond quickly to the shifting of the tilt lever, and the manipulation of the tilt lever is thus difficult.

SUMMARY OF THE INVENTION

Accordingly, it is an objective of the present invention to provide a tilt control device for a forklift that restricts the maximum tilt speed of a mast when a fork is located at a higher position and facilitates manipulation of a tilt lever for tilting the mast.

To achieve the above described objective, a tilt control device of a forklift mast according to the present invention includes a hydraulic cylinder for tilting the mast. A first valve is provided for controlling supply of a fluid to the cylinder for cylinder operation. The device also includes an operating member for operating the first valve. The first valve supplies fluid to the cylinder in correspondence with the position of the operating member. The cylinder tilts the mast at a speed corresponding to the flow rate of the fluid supplied by the first valve. A fluid passage is arranged between the cylinder and the first valve. A second valve is provided for restricting the maximum flow rate of the fluid passing through the fluid passage. The second valve varies the maximum flow rate depending on the position of the fork.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best by understood by reference to the following description of the presently preferred embodiments together with the accompanying drawings.

DETAILED DESCRIPTION OF THE PREFERRED EMBODIMENTS

Figure 1:
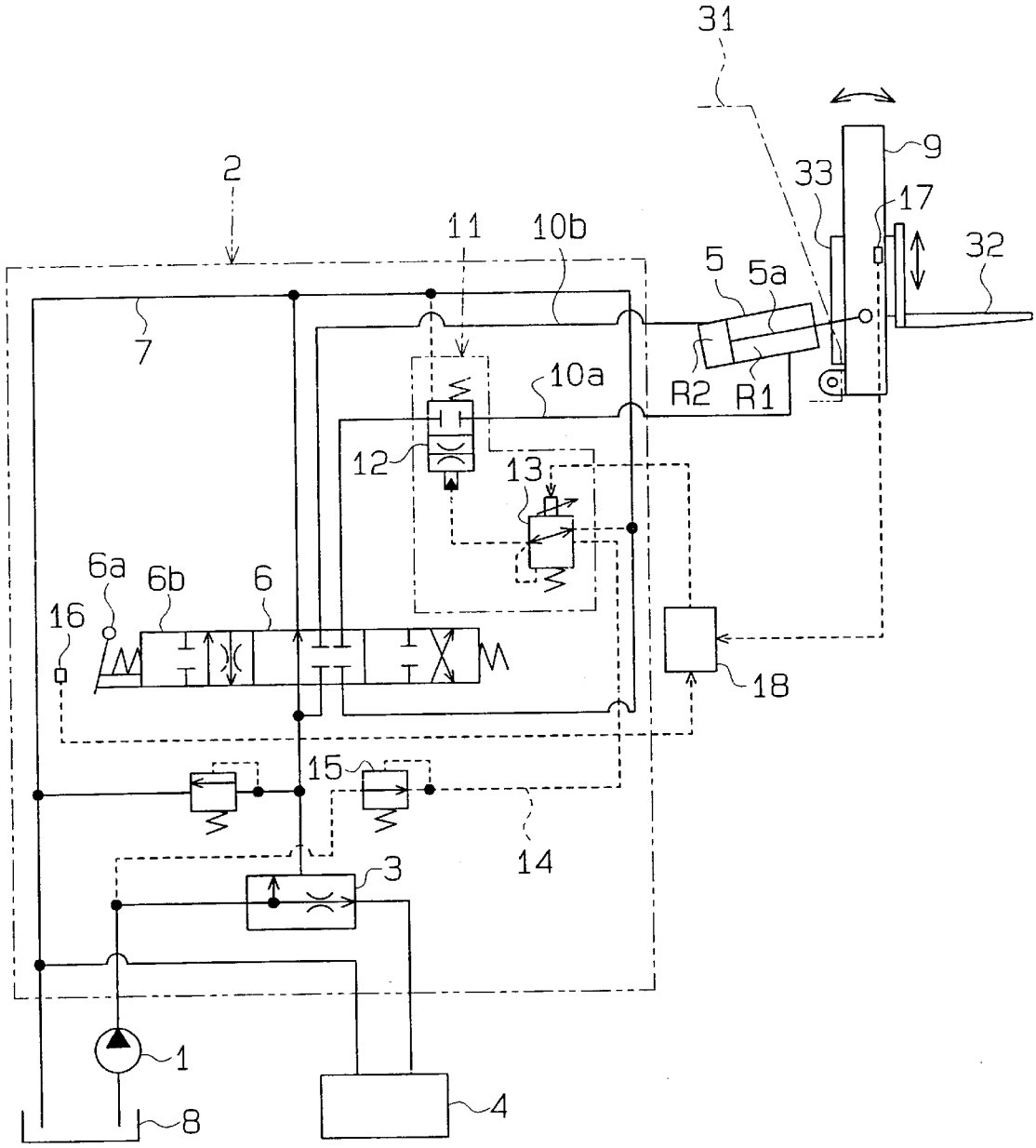
FIG. 1 is a hydraulic circuit diagram showing a tilt control device of a first embodiment according to the present invention.

A first embodiment of the tilt control device according to the present invention will now be described with reference to FIGS. 1 to 3. As shown in FIG. 1, a mast 9 is supported by a vehicle body 31 at the lower end of the mast 9. The mast 9 tilts, or pivots, forward and rearward with respect to the body 31. A fork 32 for carrying an object is supported by the mast 9 so that the fork 32 is lifted or lowered. The mast 9 is connected with body 31 by a tilt cylinder 5 having a piston rod 5*a*. The rod 5*a* is projected or retracted to tilt the mast 9. A lift cylinder 33 arranged along the mast 9 lifts or lowers the fork 32 along the mast 9 through a transmission mechanism such as a chain.

A hydraulic pump 1 supplies oil from an oil reservoir 8 to a valve unit 2. The valve unit 2 controls the oil supply for the tilt cylinder 5. The valve unit 2 includes a distributor valve 3, which distributes the oil from the hydraulic pump 1 to the tilt cylinder 5 and a power steering device 4. A switch valve 6 is also provided in the valve unit 2 for operating the tilt cylinder 5. The switch valve 6 includes a spool 6*b* moving in coordination with a tilt lever 6*a*, which is arranged in the vicinity of the operator seat of the forklift. In other words, the switch valve 6 is manually operable by means of the tilt lever 6*a*. The tilt lever 6*a* is located at a neutral position when it is not shifted. The tilt lever 6, for example, forward or rearward with respect to the neutral position. When the tilt lever 6*a* is not shifted, the spool 6*b* is arranged at a neutral position, as shown in FIG. 1. In this state, oil is returned to the oil reservoir 8 through an outlet channel 7 after having been supplied by the pump 1 to the switch valve 6 via the distributor valve 3.

A piston divides the interior of the tilt cylinder 5 into a first chamber R1 and a second chamber R2. The first chamber R1 is connected with the switch valve 6 by a first oil passage 10*a*, while the second chamber R2 is connected with the switch valve 6 by a second oil passage 10*b*. When the tilt lever 6 *a* is tilted reward from the neutral position, the oil supplied by the hydraulic pump 1 is sent to the first chamber R1 via the first oil passage 10*a*. Meanwhile, the oil in the second chamber R2 is returned to the oil reservoir 8 through the second oil passage 10*b*, the switch valve 6, and the outlet channel 7. When the tilt lever 6*a* is tilted forward from the neutral position, the oil supplied by the hydraulic pump 1 is sent to the second chamber R2 via the second oil passage 10*b*. Meanwhile, the oil in the first chamber R1 is returned to the oil reservoir 8 through the first oil passage 10*a*, the switch valve 6, and the outlet channel 7. The opening of the switch valve 6 varies in correspondence with the position of the tilt lever 6*a*, or the angle of the tilt lever 6*a* with respect to its neutral position, thus varying the oil flow passing the switch valve 6. Although, FIG. 1 shows an on-off type valve 6, the valve 6 is preferably a continuously variable type such that the valve opening size varies continuously as a function of the position of the lever 6*a*.

A flow restricting valve 11 is provided in the first oil passage 10*a*. The valve 11 restricts the maximum flow rate of the oil supplied by the switch valve 6 to the tilt cylinder 5. The valve 11 is constituted by, for example, an electromagnetic type flow control valve, the opening of which varies in correspondence with the value of the current supplied to the valve 11.

The restricting valve 11 includes a main valve 12 and a solenoid valve 13. The main 12 adjusts the oil flow in the first oil passage 10*a*, while the solenoid valve 13 applies a pilot pressure to the main valve 12. The oil supplied by the hydraulic pump 1 is introduced directly to the solenoid valve 13 via a pilot line 14. The solenoid valve 13 generates electromagnetic force in correspondence with the value of the current supplied to a coil (not shown) provided in the valve 13. The solenoid valve 13 then applies the pilot pressure, according to the electromagnetic force, to the main valve 12, by means of the oil in the pilot line 14. While FIG. 1 shows the valves 12, 13 to be on-off type valves, their opening sizes are preferably continuously variable. That is, the solenoid valve 13 is varied based on the input current, and the main valve 12 is varied based on the pilot pressure. A depressurizing valve 15 is provided in the pilot line 14 for determining the maximum value of the pilot pressure.

The main valve 12 includes a spool urged by a spring in one direction. The pilot pressure and the spring urge the spool in opposite directions. Balance, or equalibrium, between the urging force of the spring and the pilot pressure determines the position of the spool. The spool position varies in correspondence with variation of the pilot pressure. Such variation of the spool position varies the opening of the main valve 12. In other words, the oil flow passing through the main valve 12 varies in correspondence with the value of the current supplied to the solenoid valve 13.

Figure 2:
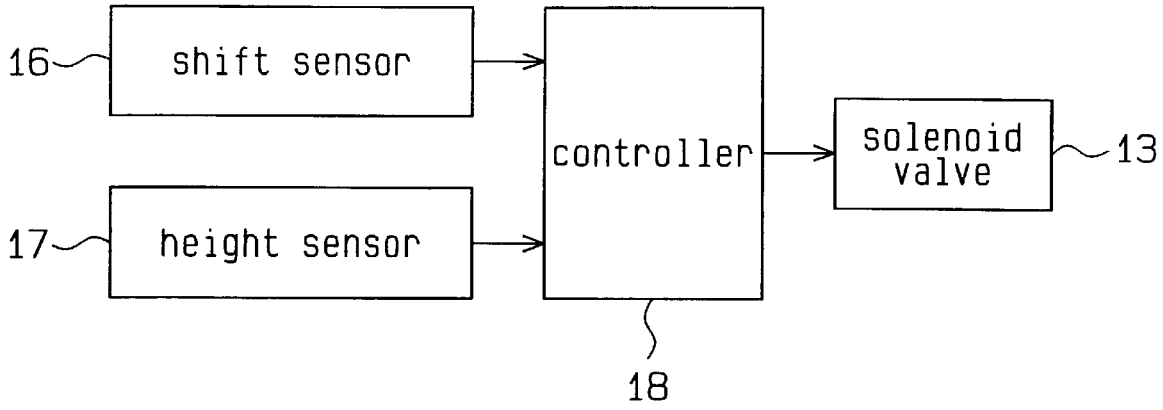
FIG. 2 is a block diagram showing the tilt control device of the first embodiment.

As shown in FIGS. 1 and 2, a shift sensor 16 is arranged in the vicinity of the tilt lever 6*a* for sensing the shifting of the lever 6*a*. The sensor 16 is constituted by, for example, a micro switch. The mast 9 is provided with a height sensor 17 detecting the height of the fork 32. The height sensor 17 is constituted by, for example, an encoder or a potentiometer, which continuously detects height variation of the fork 32 and outputs a signal in correspondence with the detected height. Alternatively, the height sensor 17 may be constituted by a proximity switch or a limit switch, which indicates whether the fork is located below a predetermined reference position simply by an ON/OFF signal. Such detection signals are sent to a controller 18 by the sensors 16, 17.

When confirming the shifting of the tilt lever 6*a* in accordance with the detection signal from the shift sensor 16, the controller 18 supplies a current to the solenoid valve 13 of the restricting valve 11 in correspondence with the detection signal from the height sensor 17. When confirming that the tilt lever 6*a* is not being shifted in accordance with the detection signal from the shift sensor 16, the controller 18 supplies no current to the solenoid valve 13. In this state, the main valve 12 of the restricting valve 11 closes the first oil passage 10*a*.

Figure 3:
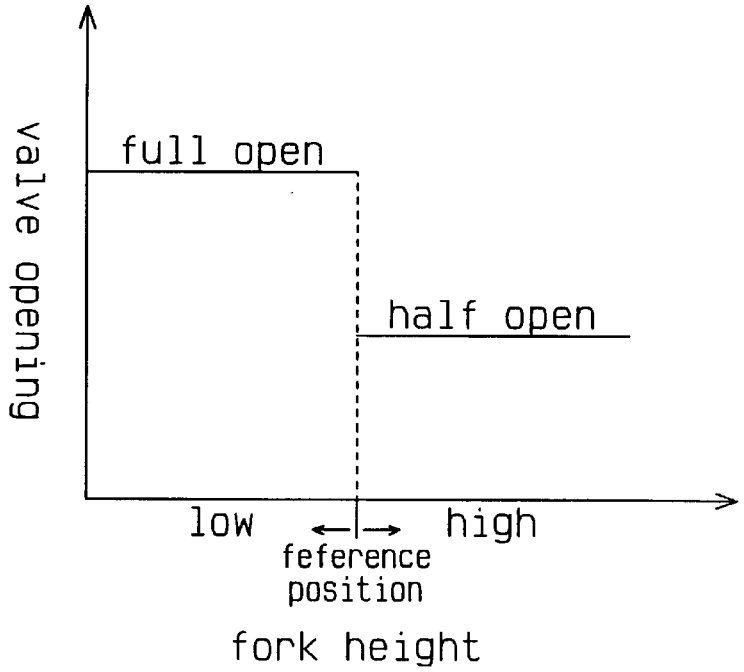
FIG. 3 is a graph showing a relationship between the height of a fork and the opening of a control valve in the tilt control device of the first embodiment.

As shown in FIG. 3, when the tilt lever 6*a* is shifted, the opening of the main valve 12 is selected between a fully open state and a half open state in correspondence with the height of the fork 32. That is, when determining that the fork 32 is located below a predetermined reference position in accordance with the detection signal from the height sensor 17, the controller 18 increases the value of the current supplied to the solenoid valve 13. The main valve 12 is thus fully open. When determining that the fork 32 is located at the reference position or higher in accordance with the detection signal from the height sensor 17, the controller 18 reduces the value of the current supplied to the solenoid valve 13. The main valve 12 is thus half open. The value of the current that fully opens the valve 12 and the value of the current that half opens the valve 12 are each predetermined.

As described above, when the tilt lever 6*a* is shifted with the fork 32 located below the reference position, the main valve 12 is fully open. This increases the maximum flow rate of the oil supplied by the switch valve 6 to the tilt cylinder 5. Thus, if the position of the tilt lever 6*a* is at maximum level, the mast 9 tilts at the maximum speed.

On the other hand, when the tilt lever 6*a* is shifted with the fork 32 located at the reference position or higher, the main valve 12 is half open. This reduces the maximum flow rate of the oil supplied by the switch valve 6 to the tilt cylinder 5. Thus, even if the position of the tilt lever 6*a* is at the maximum level, the tilt speed of the mast 9 is less than when the valve 12 is fully open. That is, the tilt speed of the mast 9 is restricted. Thus, regardless of rapid movement of the tilt lever 6*a* to its maximum tilt angle while the fork 32 is located at a higher position while carrying an object, the object does not become unstable or fall from the fork 32. Furthermore, there is less risk that a rear wheel of the forklift will be raised from the ground.

As described above, the restricted valve 11 determines the maximum flow rate of the oil supplied to the tilt cylinder 5. Thus, the tilt speed of the mast 9 corresponds to the position of the tilt lever 6*a* unless such speed reaches the maximum value determined by such maximum flow rate.

In the first embodiment, the value of the current that fully opens the restricting valve 11 and the value of the current that half opens the valve 11 are each predetermined. When the tilt lever 6*a* is shifted, the associated predetermined value of current is supplied to the valve 11 in correspondence with the height of the fork 32. The valve 11 is then fully open or half open. Thus, the time lag between the shifting of the tilt lever and the operation of the valve 11 decreases as compared to the typical control method, which gradually varies the output current value in correspondence with the position of the tilt lever. Therefore, the operation of the tilt cylinder 5 responds quickly to the shifting of the tilt lever 6*a*, thus making the manipulation of the tilt lever 6*a* easier.

The restricting valve 11 permits two levels of maximum flow rate of the oil supplied to the tilt cylinder 5. The flow characteristic of the valve 11 thus need only be adjusted to ensure those two levels of maximum flow rate, which is relatively simple. Thus, the variance of flow characteristics from one unit to another is minimized.

When the engine of the forklift is stopped, or the forklift does not operate, no current is supplied to the solenoid valve 13 of the restricting valve 11. The valve 11 thus closes the first oil passage 10*a*. In this state, the shifting of the tilt lever 5*a* does not tilt the mast 9. In other words, the mast 9 is locked so that it does not tilt. Thus, if the engine of the forklift is stopped with the object carried on the fork 32, the object does not fall from the fork 32.

Furthermore, the opening of the restricting valve 11 may be selected among three or more levels instead of two levels, in correspondence with the height of the fork 32.

Figure 4:
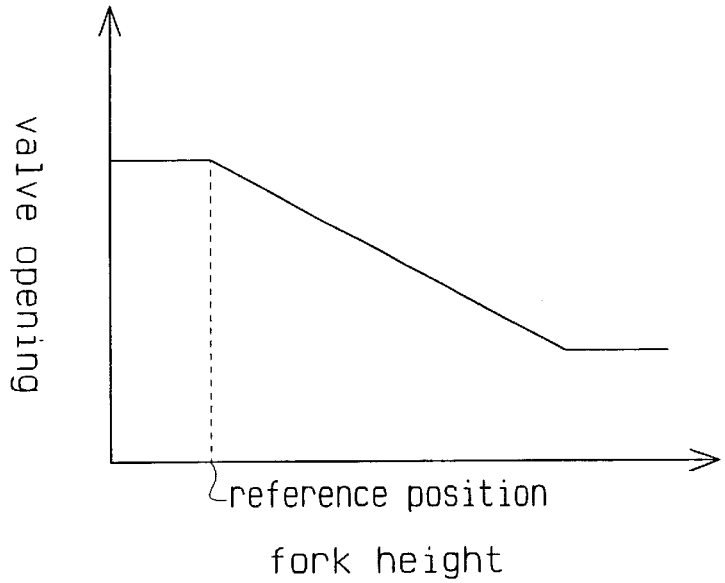
FIG. 4 is a graph showing a relationship between the height of a fork and a opening of a control valve in a tilt control device of a second embodiment.

A second embodiment according to the present invention will hereafter be described with reference to FIG. 4. In the second embodiment, the control method of the restricting valve 11 differs from that of the first embodiment. This embodiment employs the hydraulic circuit shown in FIG. 1, like the first embodiment. As shown in FIG. 4, when the fork 32 is located below the predetermined reference position, the valve 11 is fully open. The mast 9 is then permitted to tilt at the maximum speed. However, when the fork 32 is located at the reference position or higher, the opening of the valve 11 varies continuously in proportion with the height variation of the fork 32. Specification, as the position of the fork 32 becomes higher, the value of the current supplied by the controller 18 to the solenoid valve 13 becomes smaller. Consequently, as the position of the fork 32 becomes higher, the maximum flow rate of the oil supplied to the tilt cylinder 5 is reduced. The maximum tilt speed of the mast 9 is then restricted to a smaller value.

To vary the opening of the restricting valve 11 continuously in relation to the height of the fork 32, for example, an encoder, a potentiometer or a ultrasonic sensor that continuously detects the fork height is employed as the height sensor 17 and a continuously variable valve is employed as the restricting valve 11.

In the second embodiment, the maximum tilt speed of the mast 9 is controlled more accurately in correspondence with the height of the fork 32.

A third embodiment according to the present invention will now be described with reference to FIG. 5. In this embodiment, a plurality of (two, in this embodiment) electromagnetic, or solenoid, type valves 19, 20 restrict the maximum flow rate of the oil supplied to the tilt cylinder 5. The valve 19, 20 are arranged in parallel in the oil passage 10*a*. Each valve 19, 20 opens or closes the passage 10*a* selectively. The controller 18 controls the valves 19, 20 in accordance with the detection signals from the shift sensor 16 and the height sensor 17.

When the tilt lever 6*a* is not shifted, no current is supplied to the solenoids of the valves 19, 20. The valves 19, 20 are thus maintained in a closed state. When the tilt lever 6*a* is shifted with the fork 32 located below the predetermined reference position, a current is supplied to the solenoids of both valves 19, 20. The valves 19, 20 are thus open. However, when the tilt lever 6*a* is shifted with the fork 32 located at the reference position or higher, current is supplied to only one solenoid of the valves 19, 20. Thus, only one valve 19, 20 opens. The remaining structure of the third embodiment is identical to that of the first embodiment.

Figure 5:
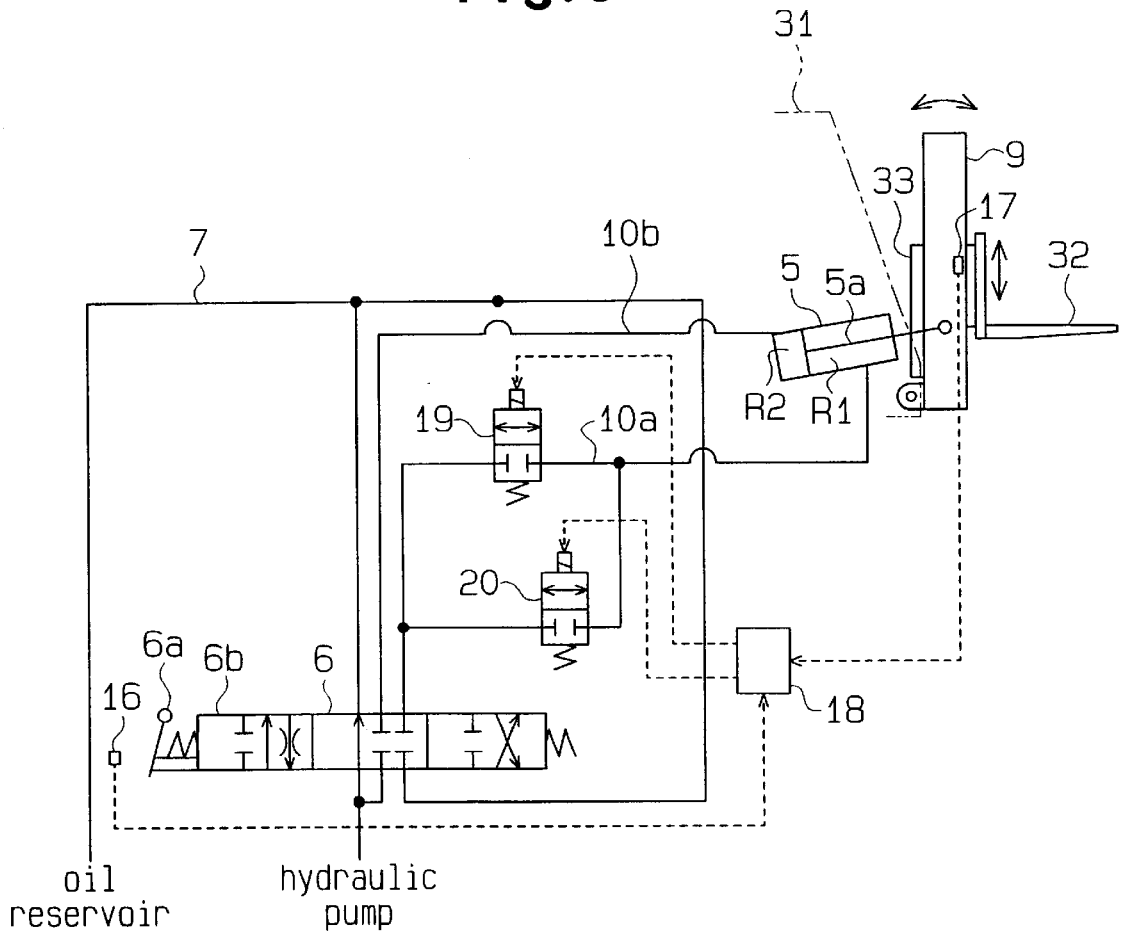
FIG. 5 is a hydraulic circuit diagram showing a tilt control device of a third embodiment according to the present invention.

In the third embodiment of FIG. 5, the maximum flow rate of the oil supplied to the tilt cylinder 5 is selected between two levels, like the first embodiment shown in FIG. 3. Specifically, the first oil passage 10*a* is fully open when the fork 32 is located below the reference position, thus increasing the maximum flow rate of the oil supplied to the tilt cylinder 5. However, the first oil passage 10*a* is half open when the fork 32 is located at the reference position or higher, thus decreasing the maximum flow rate of the oil supplied to the tilt cylinder 5. In this state, the maximum tilt speed of the mast 9 is restricted as compared to the case when the fork 32 is located below the reference position.

Furthermore, the maximum flow rate of the oil supplied to the cylinder 5 is selected in accordance with the ON/OFF status of the two valves 19, 20, thus simplifying the control. The operation of the tilt cylinder 5 then responds more quickly to the manipulation of the tilt lever 5. In addition, when the engine of the forklift is stopped, the mast 9 is locked so that is does not tilt, like the first embodiment.

A fourth embodiment according to the present invention will hereafter be described with reference to FIG. 6. In this embodiment, the restricting valve 21 is constituted by an electromagnetic type flow adjusting valve that is normally open. The valve 21 includes a main valve 22, or a two-position switch type valve, and a solenoid valve 23 that applies a pilot pressure to the main valve 22. The opening of the main valve 22 is selected between a fully open state and a half open state. The solenoid valve 23 is connected with the pilot line 14, like the first embodiment. When the solenoid valve 23 is excited by the controller 18, the pilot pressure is applied to the main valve 22. When the solenoid valve 23 is not excited by the controller 18, the pilot pressure is not applied to main valve 22. The remaining structure of the fourth embodiment is identical to that of the first embodiment.

The controller 18 controls the restricting valve 21 in accordance simply with the detection signal from the height sensor 17. Specifically, if the controller 18 determines that the fork 32 is located below the predetermined reference position in accordance with the detection signal from the height sensor 17, no current is supplied to the solenoid valve 23. The pilot pressure is thus not applied to the main valve 22, and the main valve 22 is maintained in the fully open state. However, if the controller 18 determines that the fork 32 is located at the reference position or higher in accordance with the detection signal from the height sensor 17, a current is supplied to the solenoid valve 23. The pilot pressure is then applied to the main valve 22, and the main valve 22 is maintained in the half open state.

Figure 6:
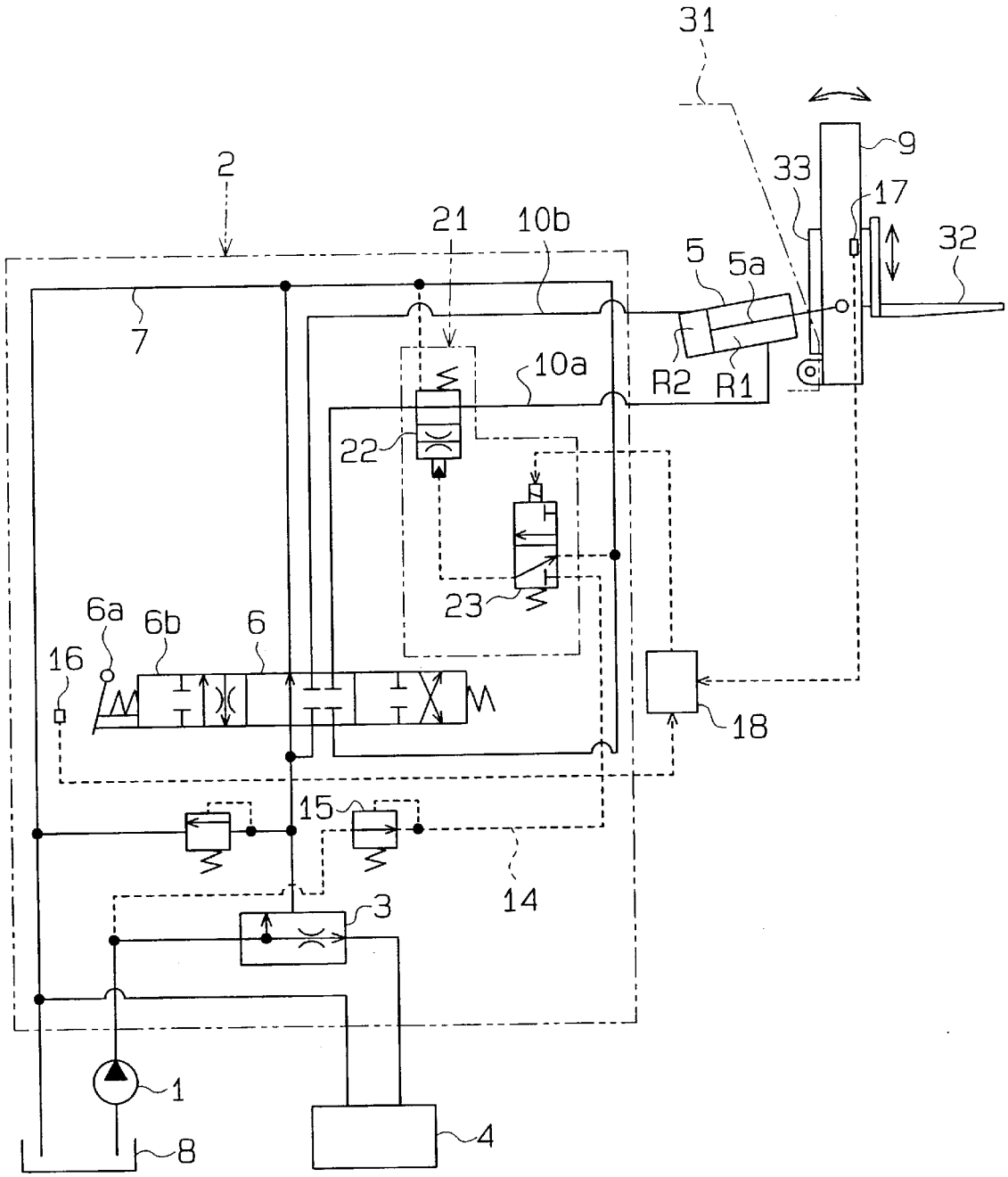
FIG. 6 is a hydraulic circuit diagram showing a tilt control device of a fourth embodiment according to the present invention.

In the fourth embodiment of FIG. 6, the maximum flow rate of the oil supplied to the tilt cylinder 5 is selected between two levels, like the first embodiment shown in FIG. 3. The same advantageous effects as in the first embodiment are thus obtained in the fourth embodiment.

Particularly, in this embodiment, the maximum flow rate of the oil supplied to the tilt cylinder 5 is selected in accordance with the ON/OFF state of the solenoid valve 23, thus facilitating the control. Furthermore, regardless of the manipulation of the tilt lever 6*a*, the opening of the main valve 22 is selected between the fully open state and the half open state in correspondence only with the height of fork 32. In other words, the main valve 22 does not operate synchronously with the shifting of the tilt lever 6*a*. Instead, the operation is completed before the tilt lever 6*a* is shifted. Thus, the operation of the tilt cylinder 5 responds more quickly to the shifting of the tilt lever 6*a*.

When the solenoid valve 23 is in a normal state, or de-excited state, the main valve 22 is maintained in the fully open state. Thus, even if the operation of the solenoid valve 23 is hindered by a problem occurring in the height sensor 17, the controller 18 or the solenoid valve 23, it is possible to tilt the mast 9 by shifting the tilt lever 6*a*. The problem then does not cause serious problems in lifting or lowering the object on the fork 32. If the main valve 22 is maintained in the half open state when the solenoid valve 23 is turned off, it is possible to tilt the mast 9 with the maximum tilt speed of the mast 9 restricted.

Furthermore, the restricting valve 21 may be controlled in accordance with the detection signals from both the height sensor 17 and the shift sensor 16, like the first embodiment. In addition, the restricting valve 11 of the first embodiment may be controlled in accordance only with the detection signal from the height sensor 17, like the fourth embodiment.

Figure 7:
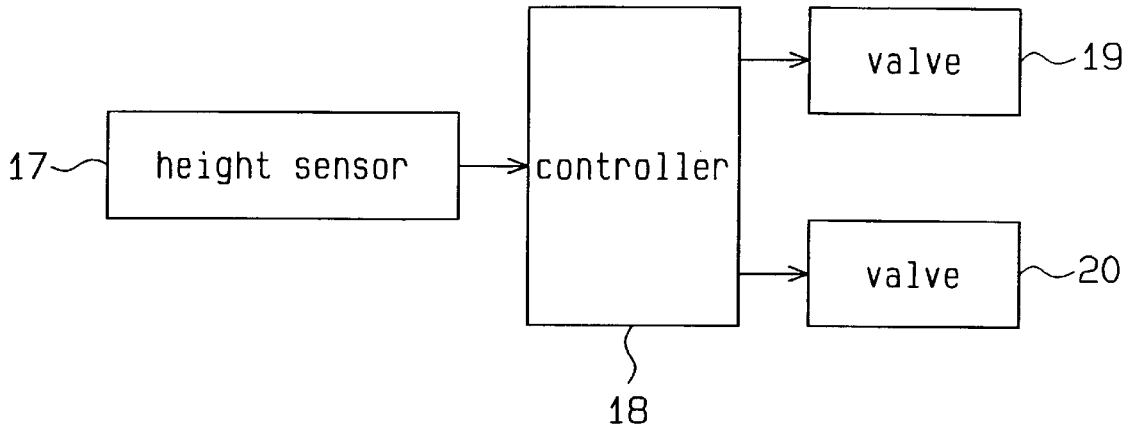
FIG. 7 is a block diagram showing a tilt control device of a fifth embodiment according to the present invention.

A fifth embodiment according to the present invention will now be described with reference to FIG. 7. This embodiment is a modification of the third embodiment shown in FIG. 5. However, unlike the third embodiment, the controller 18 of the fifth embodiment controls the valves 19, 20 in accordance only with the detection signal from the height sensor 17. Specifically, when determining that the fork 32 is located below the predetermined reference position in accordance with the detection signal from the height sensor 17, the controller 18 supplies a current to the solenoids of both valves 19, 20. The valves 19, 20 are thus open. However, when determining that the fork 32 is located at the reference position or higher in accordance with the detection signal from the height sensor 17, the controller 18 supplies a current to one solenoid of the associated valve 19, 20. Thus, only one valve 19, 20 opens.

As described above, regardless of the manipulation of the tilt lever 6*a*, the valves 19, 20 of the fifth embodiment are controlled in accordance only with the height of the fork 32. Thus, like the fourth embodiment, the operation of the valve 19, 20 is completed before the tilt lever 6*a* is shifted. The operation of the tilt cylinder 5 then responds more quickly to the manipulation of the tilt lever*a*.

The present invention is not restricted to the above described embodiments, and may be embodied as follows.

Figure 8:
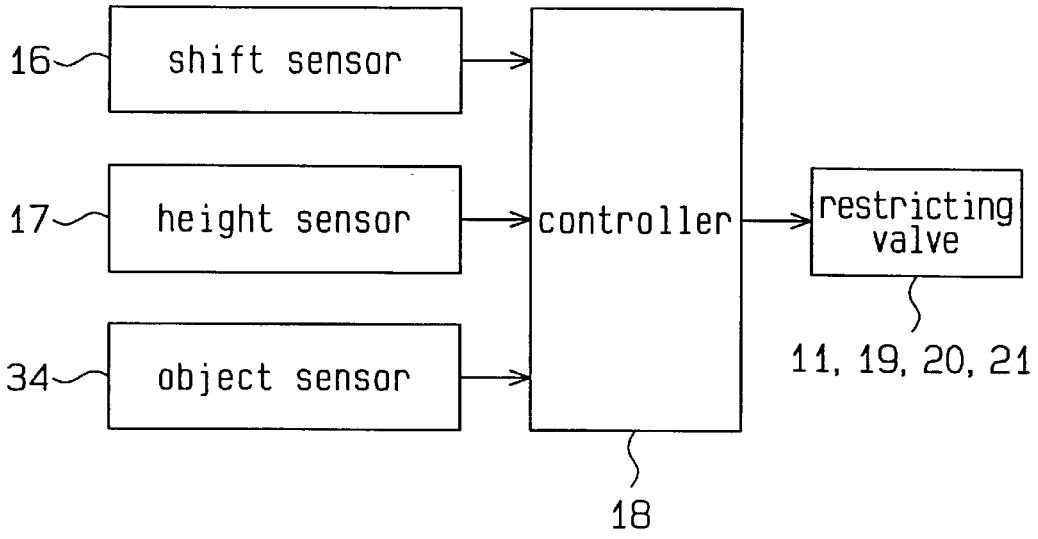
FIG. 8 is a block diagram showing a tilt control device of a sixth embodiment according to the present invention.

In the first to fifth embodiments, when the fork 32 carries no object, the maximum flow rate of the oil to the tilt cylinder 5 need not be restricted even if the fork 32 is located at the predetermined reference position or higher. Specifically, like a sixth embodiment shown in FIG. 8, the lift cylinder 33 includes an object sensor 34 sensing the object carried on the fork 32. The object sensor 34 includes, for example, a pressure sensor detecting hydraulic pressure in the interior of left cylinder 33 as the weight of the object on the fork 32. The controller 18 controls the valves 11, 19, 20, 21 in accordance with the detection signals from the height sensor 17 and the object sensor 34, and, if necessary, the detection signal from the shift sensor 16.

Furthermore, as long as the object on the fork 32 is relatively light, the maximum flow rate of the oil to the tilt cylinder 5 need not be restricted even if the fork 32 is located at the reference position or higher. The restriction may be activated only when the weight of the object on the fork 32 is larger than a predetermined value while the fork 32 is located at the reference position or higher. In addition, the restricted amount of such maximum flow rate may be varied in a stepped manner or continuously in relation to the weight of the object.

The restricted maximum flow rate of the oil to the tilt cylinder 5 may be varied in relation to the height of the fork 32 and the tilt angle of the mast 9. In other words, when the fork 32 is located at the reference position or higher, the valve is more restricted as the tilt angle of the mast 9 increases. Alternatively, the degree of restriction may be varied in relation to the height of the fork 32 and the moment that acts to tilt the mast 9 forward. Such moment is determined by the weight of the object, the tilt angle of the mast 9, and the height of the fork 32. The value of the moment may be obtained based on pressure acting in the interior of the tilt cylinder 5 detected by a sensor (not shown). When the fork 32 is located at the reference position or higher, the maximum flow rate is more restricted as the value of the moment increases. Such a method enables the object to be lowered or lifted in a more stable manner.

In the first to fifth embodiments, the valves 11, 19, 20, 21 may be provided in the second oil passage 10*b*, instead of the first oil passage 10*a*. Furthermore, restriction of the maximum flow rate of the oil to the tilt cylinder 5 may be performed during both forward tilt and rearward tilt of the mast 9 with respect to the vehicle body 31. Alternatively, the restriction may be performed during only the forward tilt or only the rearward tilt of the mast 9 with respect to the vehicle body 31.

Therefore, the present examples and embodiments are to be considered as illustrative and not restrictive and the invention is not to be limited to the details given herein, but may be modified within the scope of the appended claims.

What is claimed is:

1. A device for controlling tilt of a mast provided in a forklift, the mast supporting a fork for carrying an object so that the fork is lifted or lowered, the device comprising:

a hydraulic cylinder for tilting the mast;

a first valve for controlling supply of a fluid to the cylinder;

an operating member for operating the first valve, wherein the first valve supplies fluid to the cylinder in correspondence with the position of the operating member, the cylinder tilting the mast at a speed corresponding to the flow rate of the fluid supplied by the first valve;

a fluid passage between the cylinder and the valve, the fluid passage including a plurality of parallel passages; and a plurality of parallel, two-way controllable valves between the first valve and the cylinder for restricting the flow rate of the fluid passing through the fluid passage depending on the height of the fork, each of the plurality of parallel valves being along a respective one of the plurality of parallel passages, whereby the flow rate of fluid through said parallel passage may be controlled by said two-way valves.

2. The device as set forth in claim 1, wherein the plurality of parallel valves increases the flow rate when the fork is located at a relatively low position and decrease the flow rate when the fork is located at a relatively high position.

3. The device as set forth in claim 2, wherein the plurality of parallel valves vary the flow rate in stepped manner in correspondence with height of the fork.

4. The device as set forth in claim 2, wherein the plurality of parallel valves close the fluid passage when the forklift is not operating.

5. The device as set further in claim 2, wherein the number of open parallel valves varies depending on the height of the fork.

6. The device as set forth in claim 5, wherein the parallel valves comprise two electromagnetic valves, said two electromagnetic valves being open when the fork is located below a predetermined reference position, and wherein one electromagnetic valve is open when the fork is located at the reference position or higher.

7. The device as set forth in claim 2 further comprising:

a height sensor for detecting the height of the fork; and a controller for controlling each of parallel valves dependent upon the detected height of the fork.

8. The device as set forth in claim 1, comprising two parallel passages and two parallel valves, one valve being along one of the two parallel passages and the other valve being along the other of the two parallel passages.

9. The device as set forth in claim 1, further comprising a controller for separately controlling each of the parallel valves, dependent on the height of the fork.

10. The device as set forth in claim 1, wherein each of the parallel valves is an electromagnetic valve, the device further comprising:

a controller for controlling electric current supplied to each of the electromagnetic valves based on the height of the fork and the operation of the operating member, wherein, when the operating member is not operated, the controller maintains the electromagnetic valves in a closed state, and wherein, when the operating member is operated, the controller selectively opens and closes each of the electromagnetic valves depending upon the height of the fork.

11. A device for controlling tilt of a mast provided in a forklift, the mast supporting a fork for carrying an object so that the fork is lifted or lowered, the device comprising:

a hydraulic cylinder for tilting the mast, the hydraulic cylinder having a pair of fluid chambers;

a fluid pump;

a first valve for controlling supply of a fluid from the fluid pump to the cylinder;

an operating lever for manually operating the first valve, wherein the first valve supplies fluid to the cylinder in correspondence with the position of the operating lever, and the cylinder tilts the mast at a speed corresponding to the flow rate of the fluid supplied by the first valve;

a fluid passage between one of the fluid chambers of the cylinder and the first valve;

a second valve for restricting the flow rate of the fluid passing through the fluid passage, the second valve being positioned along the fluid passage, between the first valve and the cylinder, wherein the second valve includes a plurality of valves, at least one of which is an electromagnetic valve;

a height sensor for detecting a height of a fork and for generating a signal indicative of the height of the fork; and a controller for controlling the electromagnetic valve dependent on the signal so that the flow rate is varied in correspondence with the position of the fork so that the flow rate increases when the fork is located at a relatively low position and the flow rate decreases when the fork is located at a relatively high position, wherein the second valve closes the fluid passage to lock to mast against tilting when the forklift is not operating.

12. The device as set forth in claim 11, wherein the controller controls the second valve so that the flow rate is varied in a stepped manner in correspondence with the height of the fork.

13. The device as set forth in claim 12, wherein the second valve comprises two electromagnetic valves arranged in parallel with respect to the fluid passage, the controller opens both valves when the fork is located below a predetermined reference position, and the controller opens one valve when the fork is located at the reference position or higher.

* * * * *

UNITED STATES PATENT AND TRADEMARK OFFICE

CERTIFICATE OF CORRECTION

PATENT NO. : 6,350,100 B1
DATED : February 26, 2002
INVENTOR(S) : Naruse et al.

It is certified that error appears in the above-identified patent and that said Letters Patent is hereby corrected as shown below:

Title page,
Add: -- [30] Foreign Application Priority Data
May 15, 1997 (JP) ……. 9-125662 --.

Column 1,
Line 44, please delete "fork) the" and insert therefor -- fork, the --;

Column 2,
Line 37, please delete "fork and a" and insert therefor -- fork and the --;

Column 3,
Line 9, please delete "lever 6," and insert therefor -- lever 6 tilts, --;
Line 21, please delete "lever 6 *a*" and insert therefor -- lever 6*a* --;
Line 56, please delete "valve 12, by" and insert therefor -- valve 12 by --;

Column 7,
Line 54, please delete "lever*a*." and insert therefor -- lever 6*a*. --;
Line 65, please delete "of left" and insert therefor -- of the left --.

Column 8,
Line 55, please delete "the valve" and insert therefor -- the first valve --;

UNITED STATES PATENT AND TRADEMARK OFFICE

CERTIFICATE OF CORRECTION

PATENT NO. : 6,350,100 B1 
DATED : February 26, 2002
INVENTOR(S) : Naruse et al.

It is certified that error appears in the above-identified patent and that said Letters Patent is hereby corrected as shown below:

Column 9,
Line 1, please delete “decrease” and insert therefor -- decreases --;
Line 4, please delete “vary” and insert therefor -- varies --;
Line 4, please delete “in stepped”and insert therefor -- in a stepped --;
Line 5, please delete “ with height” and insert therefor -- with the height --;
Line 7, please delete “close” and insert therefor -- closes --.

Signed and Sealed this

Third Day of September, 2002

*Attest:*

*Attesting Officer*

JAMES E. ROGAN
*Director of the United States Patent and Trademark Office*